US010380934B2

(12) United States Patent
Kim et al.

(10) Patent No.: US 10,380,934 B2
(45) Date of Patent: Aug. 13, 2019

(54) DISPLAY DRIVING DEVICE FOR REDUCING BRIGHTNESS DEVIATION OF DISPLAY PANEL

(71) Applicant: Samsung Electronics Co., Ltd., Suwon-si, Gyeonggi-do (KR)

(72) Inventors: Yang Hyo Kim, Hanam-si (KR); Yong Soo Lee, Busan (KR); Min Su Ha, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 112 days.

(21) Appl. No.: 15/656,209

(22) Filed: Jul. 21, 2017

(65) Prior Publication Data

US 2018/0277034 A1 Sep. 27, 2018

(30) Foreign Application Priority Data

Mar. 27, 2017 (KR) ..... 10-2017-0038563

(51) Int. Cl.

| | |
|---|---|
| ***G09G 5/12*** | (2006.01) |
| ***G09G 3/20*** | (2006.01) |
| ***G09G 3/3225*** | (2016.01) |

(52) U.S. Cl.

CPC ..... *G09G 3/2092* (2013.01); *G09G 3/3225* (2013.01); *G09G 2310/0291* (2013.01); *G09G 2310/08* (2013.01); *G09G 2320/0233* (2013.01)

(58) Field of Classification Search

CPC ... G09G 5/12; G09G 5/18; G09G 2310/00–08
See application file for complete search history.

(56) References Cited

U.S. PATENT DOCUMENTS

| | | | | |
|---|---|---|---|---|
| 6,295,045 | B1 | 9/2001 | Furuhashi et al. | |
| 6,924,843 | B1 | 8/2005 | Yamazaki et al. | |
| 8,644,782 | B2 | 2/2014 | Tripathi et al. | |
| 8,780,144 | B2 | 7/2014 | Kikuta | |
| 9,318,072 | B2 | 4/2016 | Cha et al. | |
| 2006/0033841 | A1* | 2/2006 | Park | G09G 5/005 348/542 |
| 2007/0001998 | A1 | 1/2007 | Smith et al. | |
| 2007/0152996 | A1* | 7/2007 | Shen | G09G 5/008 345/213 |

(Continued)

*Primary Examiner* — Sanghyuk Park
(74) *Attorney, Agent, or Firm* — Sighrue Mion, PLLC

(57) ABSTRACT

A display driving device includes an interface, a clock generator, a sync signal generator and a timing controller. The interface receives a first vertical sync signal having a first vertical period, a first horizontal sync signal having a first horizontal period shorter than the first vertical period, and image data. The clock generator generates a clock signal having a predetermined frequency. The sync signal generator generates a second vertical sync signal using the first vertical sync signal, and generates a second horizontal sync signal having a second horizontal period different from the first horizontal period, using the clock signal, when a porch period included in the first vertical period is greater than a predetermined reference value. The timing controller drives a display panel based on the second vertical sync signal and the second horizontal sync signal.

19 Claims, 15 Drawing Sheets

(56) References Cited

U.S. PATENT DOCUMENTS

| | | | | |
|---|---|---|---|---|
| 2014/0204099 | A1* | 7/2014 | Ye | H04N 21/42653<br>345/503 |
| 2015/0138212 | A1 | 5/2015 | Bae et al. | |
| 2016/0196781 | A1 | 7/2016 | Tanaka et al. | |
| 2018/0090105 | A1* | 3/2018 | Suzuki | H04N 5/04 |

* cited by examiner

DISPLAY DRIVING DEVICE FOR REDUCING BRIGHTNESS DEVIATION OF DISPLAY PANEL

CROSS-REFERENCE TO RELATED APPLICATIONS

This application claims priority from Korean Patent Application No. 10-2017-0038563, filed on Mar. 27, 2017, in the Korean Intellectual Property Office, the disclosure of which is incorporated herein in its entirety by reference.

BACKGROUND

1. Field

The present inventive concept relates to a display driving device.

2. Description of Related Art

Flat panel displays, used in electronic devices such as televisions, laptop computers, monitors, mobile devices, or the like to display images, include liquid crystal devices (LCDs), organic light emitting devices (OLEDs), and the like. Flat panel devices may include a panel having a plurality of pixels and a driving device applying an electrical signal to the pixels. In addition, images may be displayed due to electrical signal that the driving device sends to the pixels. The driving device may drive the panel based on a timing signal generated by itself, or using a timing signal received from another processor.

SUMMARY

An aspect of the present inventive concept may provide a display driving device capable of significantly reducing a change in brightness that may occur in a display device.

According to an example embodiment of the present inventive concept, a display driving device may include an interface, a clock generator, a sync signal generator, and a timing controller. The interface receives a first vertical sync signal having a first vertical period, a first horizontal sync signal having a first horizontal period shorter than the first vertical period, and image data. The clock generator generates a clock signal having a predetermined frequency. The sync signal generator generates a second vertical sync signal, using the first vertical sync signal, and generates a second horizontal sync signal having a second horizontal period different from the first horizontal period, using the clock signal, when a porch period included in the first vertical period is greater than a predetermined reference value. The timing controller drives a display panel based on the second vertical sync signal and the second horizontal sync signal.

According to an example embodiment of the present inventive concept, a display driving device may include an interface, a sync signal generator, a timing controller, and a buffer. The interface receives a first vertical sync signal having a first vertical period, a first horizontal sync signal having a first horizontal period shorter than the first vertical period, and image data. The sync signal generator generates a second vertical sync signal having the first vertical period, and a second horizontal sync signal having a second horizontal period longer than the first horizontal period. The timing controller inputs the image data to a display panel in response to the second horizontal sync signal during an active period of the first vertical period. The buffer stores a portion of the image data not input to the display panel during the active period.

BRIEF DESCRIPTION OF DRAWINGS

The above, and other aspects, features, and advantages of the present disclosure will be more clearly understood from the following detailed description when taken in conjunction with the accompanying drawings, in which.

DETAILED DESCRIPTION

Example embodiments of the present inventive concept will hereinafter be described with reference to the accompanying drawings.

Figure 1:
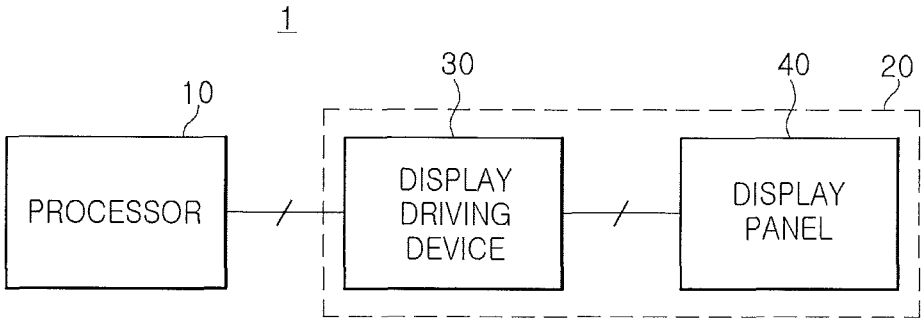
FIG. 1 is a block diagram of a display system including a display driving device according to an example embodiment.

FIG. 1 is a block diagram of a display system 1 including a display driving device according to an example embodiment.

Referring to FIG. 1, the display system 1 according to the example embodiment may include a processor 10 and a display device 20, and the display device 20 may include a display driving device 30 and a display panel 40.

In the case of a mobile device, the processor 10 may be an application processor (AP), and in the case of a desktop computer or a laptop computer, the processor 10 may be a central processing unit (CPU). For example, the processor 10 may be interpreted to mean a processing device having an operation function. The processor 10 may generate image data to be displayed on the display device 20, or may receive image data from a memory, a communications module, or the like and transmit the image data to the display driving device 30.

The display device 20 may include the display driving device 30 and the display panel 40. The display driving device 30 may include a gate driver and a source driver inputting the image data transmitted by the processor 10 to the display panel 40, and may include a timing controller controlling the gate driver and the source driver. The timing controller may control the gate driver and the source driver according to a vertical sync signal and a horizontal sync signal.

The display driving device 30 may communicate with the processor 10 through a predetermined communications interface. In an example embodiment, the display driving device 30 may communicate with the processor 10 through a high-speed serial interface such as a mobile industry processor interface (MIPI) or the like. When the processor 10 communicates with the display driving device 30 through the MIPI, the display driving device 30 may operate in either a command mode for receiving only image data from the processor 10 or a video mode for receiving image data and a timing control signal from the processor 10.

Figure 2:
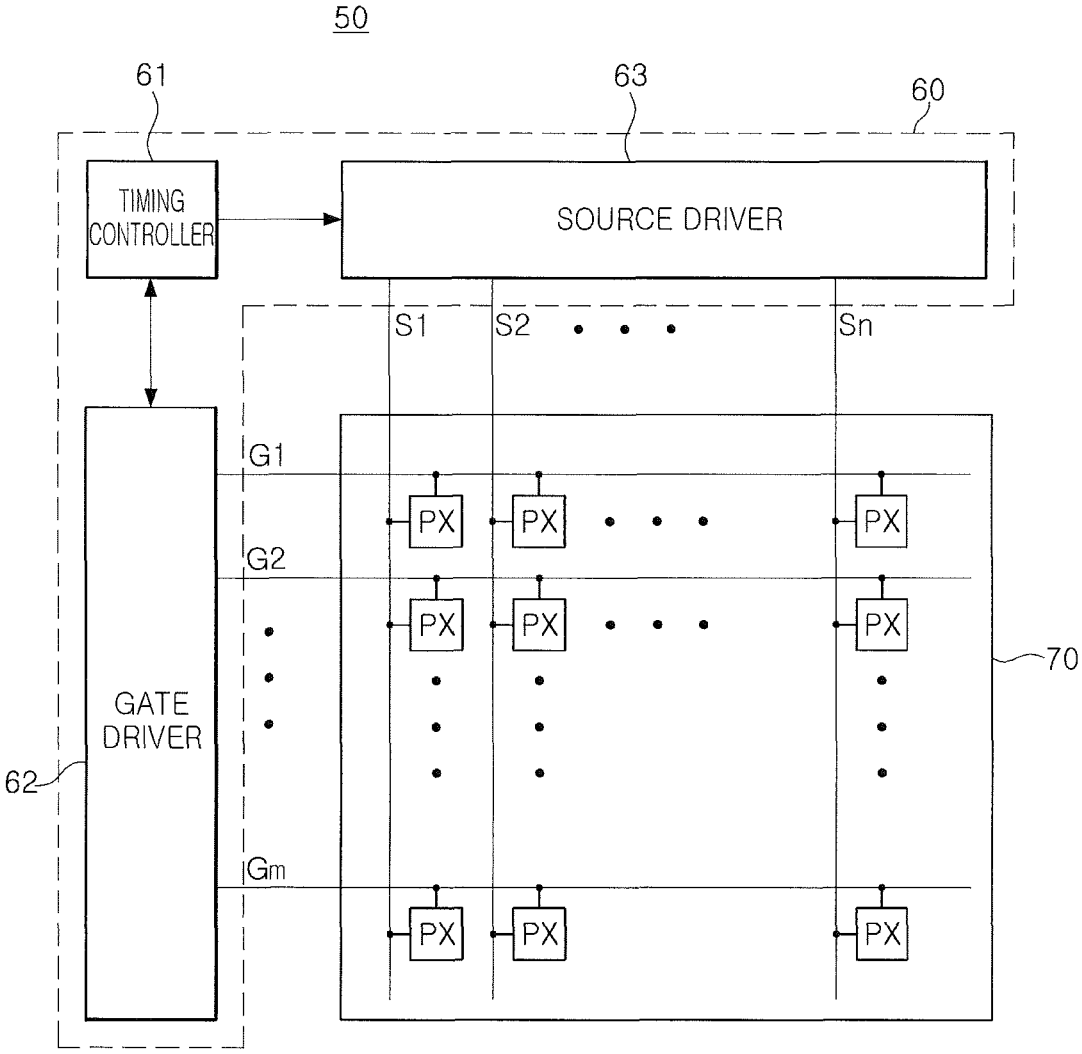
FIG. 2 is a block diagram of a display device including a display driving device according to an example embodiment.

FIG. 2 is a block diagram of a display device 50 including a display driving device 60 according to an example embodiment.

Referring to FIG. 2, the display device 50 may include the display driving device 60 and a display panel 70. The display driving device 60 may include a timing controller 61, a gate driver 62, and a source driver 63. The display panel 70 may include a plurality of pixels PXs disposed on a plurality of gate lines G1 to Gm and a plurality of source lines S1 to Sn.

In an example embodiment, the display device 50 may display an image in frame units. A time required to display one image frame may be defined as a vertical period, and the vertical period may be determined by a refresh rate of the display device 50. In an example embodiment, when the refresh rate of the display device 50 is 60 Hz, the vertical period may be 1/60 second, about 16.7 msec.

For one vertical period, the gate driver 62 may scan each of the gate lines G1 to Gm. A time for the gate driver 62 to scan each of the gate lines G1 to Gm may be defined as a horizontal period. For one horizontal period, the source driver 63 may input image data to the pixels PX.

The horizontal period and the vertical period may be determined by the timing controller 61. When the display device 50 is connected to an external processor through an MIPI, the timing controller 61 may determine the horizontal period and the vertical period in the command mode. In contrast, in the video mode, the timing controller 61 may use the horizontal period and the vertical period that the processor generates and transmits through the MIPI.

In an example embodiment, the horizontal period transmitted through the MIPI in the video mode may be shorter than a horizontal period required to display the image data on the display panel 70. In particular, when the display device 50 is an organic electroluminescent display (OLED) device, the display device 50 may require a relatively long horizontal period. When the display driving device 60 operates according to the horizontal period transmitted through the MIPI in the video mode, a sufficient length of the horizontal period may not be provided, and thus a brightness deviation of the display device 50 may occur in each image frame.

Figure 3:
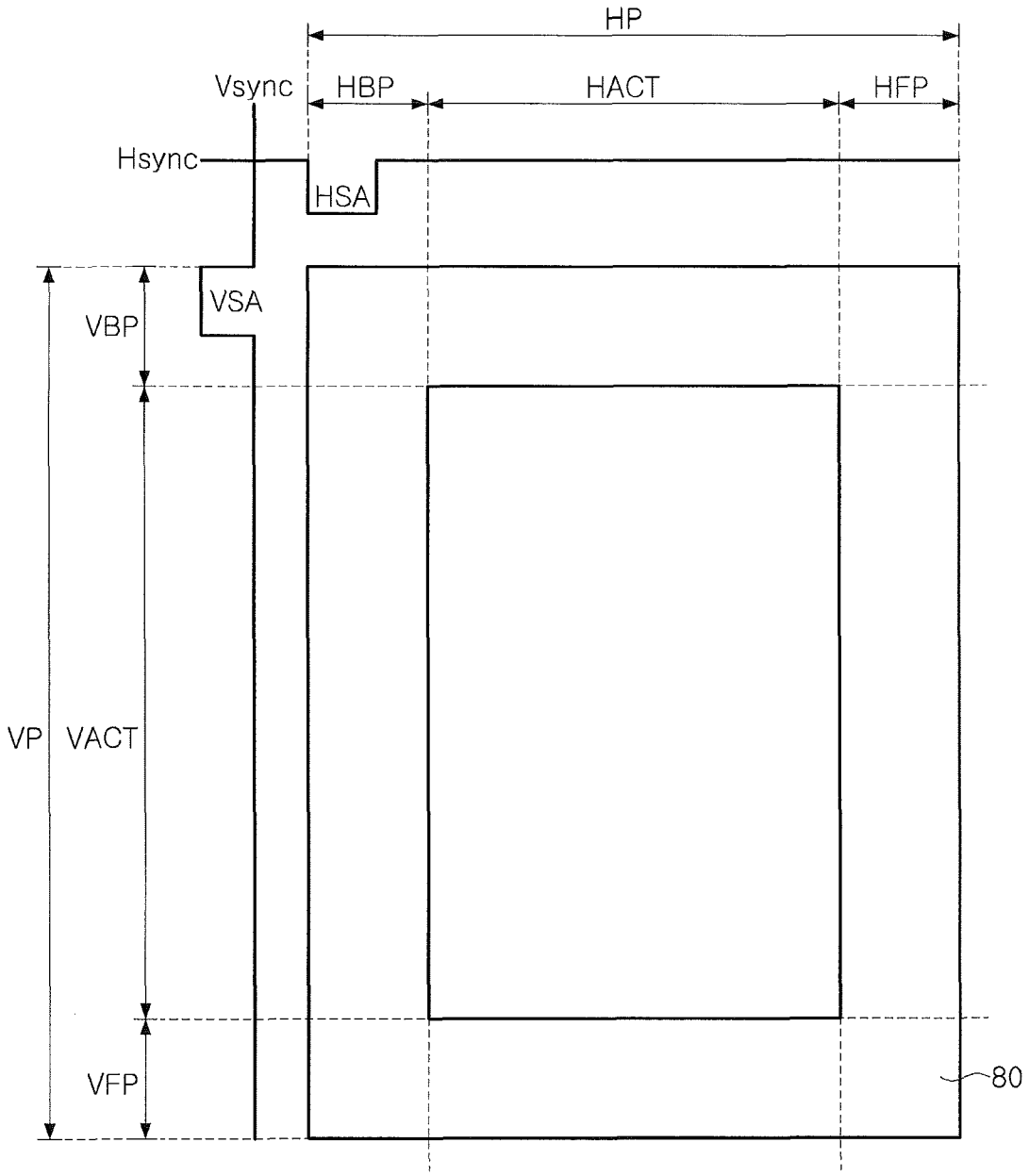
FIG. 3 is a diagram illustrating operations of a display driving device according to an example embodiment.

FIG. 3 is a diagram illustrating operations of a display driving device according to an example embodiment.

Referring to FIG. 3, a display panel 80 may operate in response to a vertical sync signal Vsync having a vertical period VP and to a horizontal sync signal Hsync having a horizontal period HP. The vertical period VP may include a first vertical porch period VBP, a vertical active period VACT, and a second vertical porch period VFP. The first vertical porch period VBP may include a vertical response period, for example, a vertical speed action VSA. In an example embodiment, the first vertical porch period VBP may be a vertical back porch period, and the second vertical porch period VFP may be a vertical front porch period.

The horizontal period HP may include a first horizontal porch period HBP, a horizontal active period HACT, and a second horizontal porch period HFP. The first horizontal porch period HBP may include a horizontal response period, for example, a horizontal speed action HSA. In an example embodiment, the first horizontal porch period HBP may be a horizontal back porch period, and the second horizontal porch period HFP may be a horizontal front porch period.

Scanning of a plurality of gate lines included in the display panel 80 and inputting of data to pixels connected to the scanned gate lines may be performed for the vertical active period VACT and the horizontal active period HACT. For example, the gate lines may be sequentially scanned during the vertical active period VACT, and data may be input to the pixels connected to the scanned gate lines during the horizontal active period HACT.

In an example embodiment, the display driving device may drive the display panel 80 using a vertical sync signal Vsync and a horizontal sync signal Hsync received from an external processor. Thus, when the horizontal active period HACT of the horizontal sync signal Hsync is shorter than a minimum time required to input the data to the pixels of the display panel 80, a brightness deviation of the display panel 80 may occur. The display driving device according to various example embodiments may generate a new vertical sync signal Vsync and a new horizontal sync signal Hsync according to operating conditions, even when receiving the vertical sync signal Vsync and the horizontal sync Hsync from the external processor. Thus, the display driving device may secure a sufficient amount of time to input data to the pixels of the display panel 80, thereby significantly reducing a brightness deviation of the display panel 80.

Figure 4:
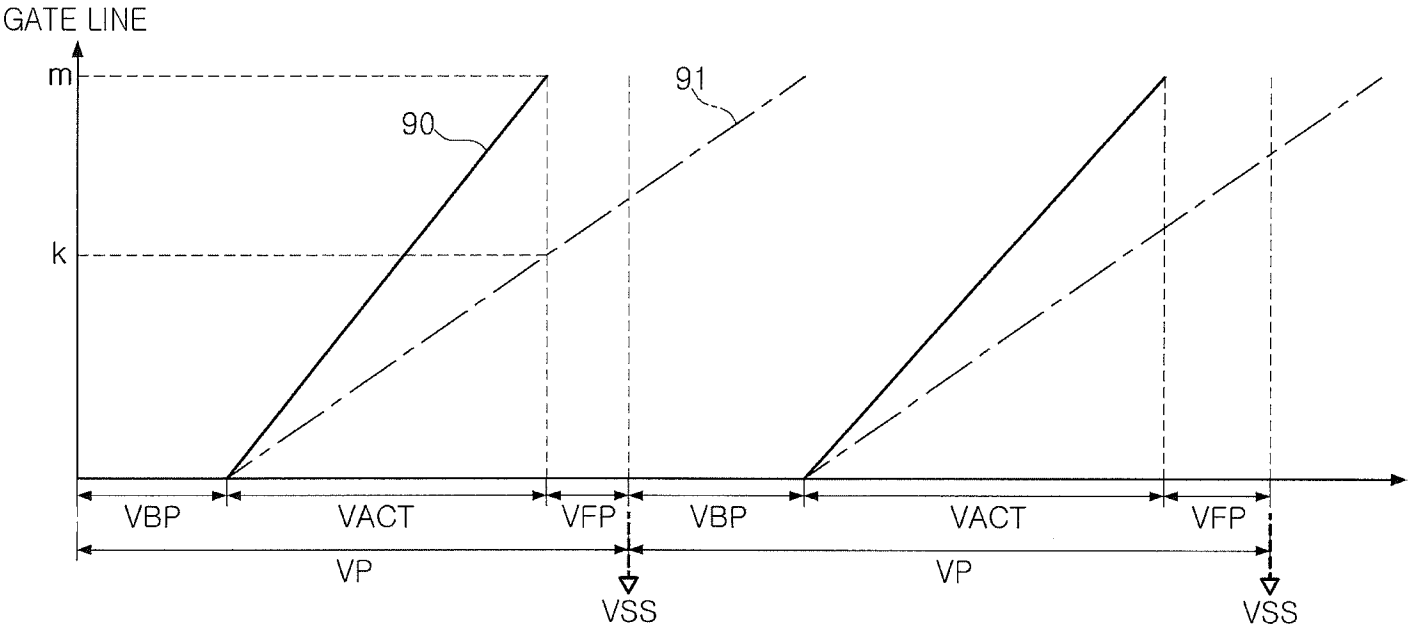
FIG. 4 is a diagram illustrating operations of a display driving device according to an example embodiment.

FIG. 4 is a diagram illustrating operations of a display driving device according to an example embodiment.

Referring to FIG. 4, a vertical period VP may include a first vertical porch period VBP, a vertical active period VACT, and a second vertical porch period VFP. A vertical sync start VSS signal for separating vertical periods VP from each other may be input therebetween. In the example embodiment illustrated in FIG. 4, the display driving device may receive a vertical sync signal and a horizontal sync signal, together with image data from an external processor, to drive a display panel.

Referring to FIG. 4, a transmission rate 90 at which the processor transmits the image data to the display driving device may be compared to an input rate 91 at which the display driving device inputs the image data to the display panel. The transmission rate 90 may correspond to a rate at which the image data is transmitted from the processor to the display driving device. The input rate 91 may correspond to a rate at which the display driving device inputs the image data to the display panel. The processor may transmit the image data to the display driving device through an interface connecting the processor to the display driving device, for example, an MIPI, for the vertical active period VACT. The display driving device may input the image data (DDI DATA) received from the processor to pixels of the display panel.

In the example embodiment illustrated in FIG. 4, the display panel may include an m number of gate lines, where m is an integer of two or more, and the display driving device may scan each of the m number of gate lines through a gate driver for the vertical active period VACT. A time required to scan each of the m number of gate lines may correspond to a horizontal period. Referring to FIG. 4, the processor may complete the transmission of the image data to the display driving device for the vertical active period VACT. In contrast, the display driving device may not input all of the image data to the display panel for the vertical active period VACT.

Such an operating difference may be caused by a difference between a horizontal period of the processor and a horizontal period of the display driving device. For example, the processor may set the horizontal period as a value for transmitting all of the image data corresponding to one image frame for the vertical active period VACT, and the display driving device may set the horizontal period as a value for securing a sufficient amount of time required to input the image data to the display panel. In an example embodiment, the horizontal period of the display driving device may be longer than that of the processor. With reference to the example embodiment illustrated in FIG. 4, the difference between the horizontal period of the display driving device and the horizontal period of the processor may cause kth to mth gate lines to not be scanned within the vertical active period VACT.

To address the issue described above, the display driving device according to an example embodiment may include a sync signal generator compensating for a difference between the horizontal periods of the display driving device and the processor. Further, the display driving device may include a buffer storing the image data to be input to the gate lines that are not scanned within the vertical active period VACT.

In an example embodiment, the sync signal generator may receive a first horizontal sync signal having a first horizontal period from the processor, and may generate a second horizontal sync signal having a second horizontal period, different from the first horizontal period. The second horizontal period may be longer than the first horizontal period, and the display driving device may secure a sufficient amount of time required to input the image data to the display panel. Thus, a brightness deviation that may occur on the display panel may be significantly reduced.

Figure 5:
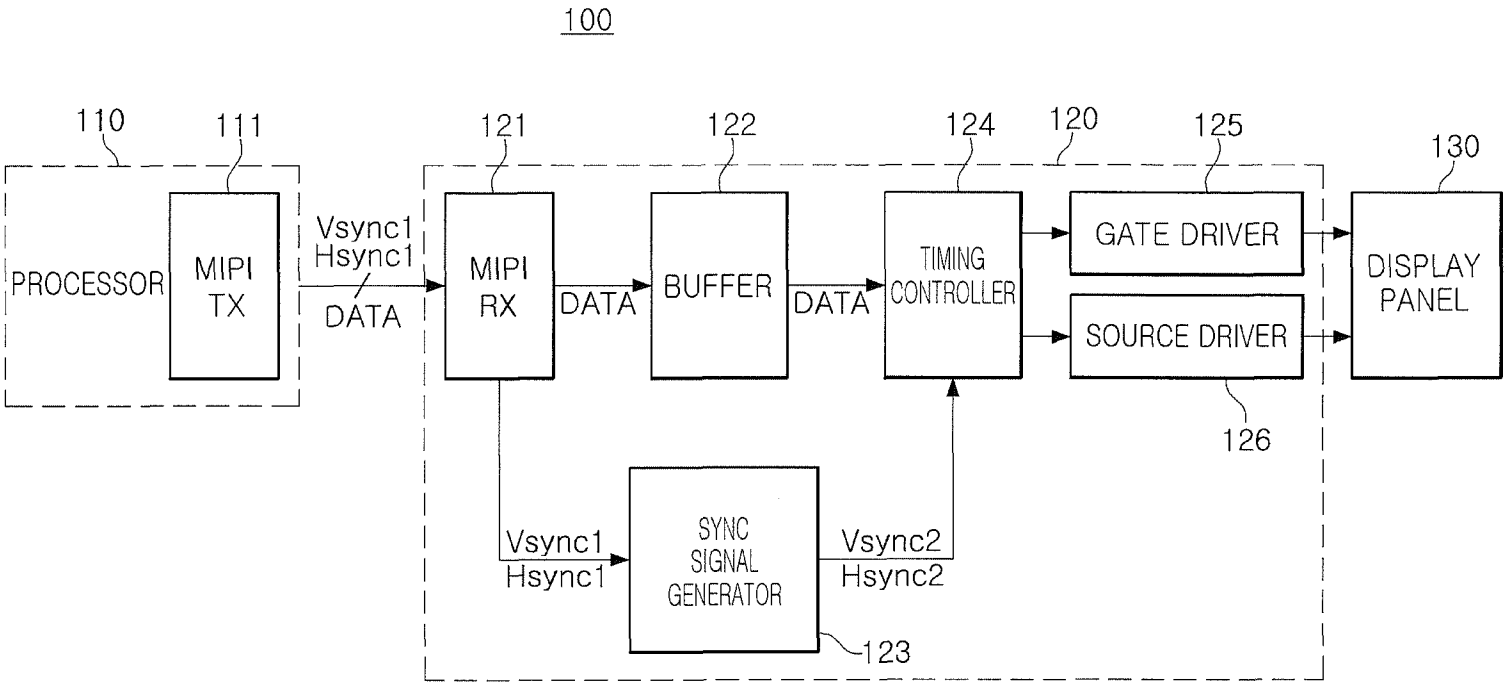
FIG. 5 is a block diagram of a display system according to an example embodiment.

FIG. 5 is a block diagram of a display system 100 according to an example embodiment.

Referring to FIG. 5, the display system 100 according to the example embodiment may include a processor 110, a display driving device 120, and a display panel 130. The processor 110 and the display driving device 120 may communicate with each other through a predetermined interface, and may communicate with each other through a high-speed serial interface such as an MIPI.

The processor 110 may transmit image data DATA, a timing signal required to drive the display panel 130, or the like. The timing signal may include a first vertical sync signal Vsync1 and a first horizontal sync signal Hsync1. The first vertical sync signal Vsync1 may have a first vertical period, and the first horizontal sync signal Hsync1 may have a first horizontal period. The image data DATA, the first vertical sync signal Vsync1, and the first horizontal sync signal Hsync1 may be transmitted from a transmission module 111 of the processor 110 to a reception module 121 of the display driving device 120.

The reception module 121 may transmit the image data DATA, the first vertical sync signal Vsync1, and the first horizontal sync signal Hsync1 to a timing controller 124. In an example embodiment, the image data DATA may be input to the timing controller 124 via a buffer 122. Further, the first vertical sync signal Vsync1 and the first horizontal sync signal Hsync1 may be input to a sync signal generator 123. The sync signal generator 123 may generate a second vertical sync signal Vsync2 and a second horizontal sync signal Hsync2, using the first vertical sync signal Vsync1 and the first horizontal sync signal Hsync1.

The timing controller 124 may input the image data DATA to pixels of the display panel 130 by controlling a gate driver 125 and a source driver 126. In an example embodiment, the timing controller 124 may control operation timing of the gate driver 125 and the source driver 126, using the second vertical sync signal Vsync2 and the second horizontal sync signal Hsync2. The second vertical sync signal Vsync2 may have a second vertical period, and the second horizontal sync signal Hsync2 may have a second horizontal period. In an example embodiment, the second horizontal period may be longer than the first horizontal period, and thus the source driver 126 may secure a sufficient amount of time required to input the image data DATA to the pixels of the display panel 130. Thus, a brightness deviation of the display panel 130 that may occur according to image frames may be significantly reduced.

The transmission module 111 and the reception module 121 may communicate with each other through an interface such as an MIPI or the like. The display driving device 120 may input the image data DATA to the pixels of the display panel 130, according to the first vertical sync signal Vsync1 and the first horizontal sync signal Hsync1 transmitted by the processor 110, when operating in a video mode of the MIPI. Here, a horizontal period required according to characteristics of the display panel 130 may be longer than the first horizontal period of the first horizontal sync signal Hsync1. Thus, the display driving device 120 may not secure a sufficient amount of time required to input the image data DATA to the pixels of the display panel 130, resulting in a brightness deviation of the display panel 130.

In an example embodiment, even when the display driving device 120 operates in the video mode of the MIPI, the display driving device 120 may input the image data DATA to the pixels of the display panel 130, according to the second vertical sync signal Vsync2 and the second horizontal sync signal Hsync2 generated by the display driving device 120, if necessary. In an example embodiment, the second horizontal period of the second horizontal sync signal Hsync2 may be longer than the first horizontal period of the first horizontal sync signal Hsync1. Thus, the display driving device 120 may secure a sufficient amount of time to input the image data DATA to the pixels of the display panel 130, thereby addressing an issue of the brightness deviation of the display panel 130.

Figure 6:
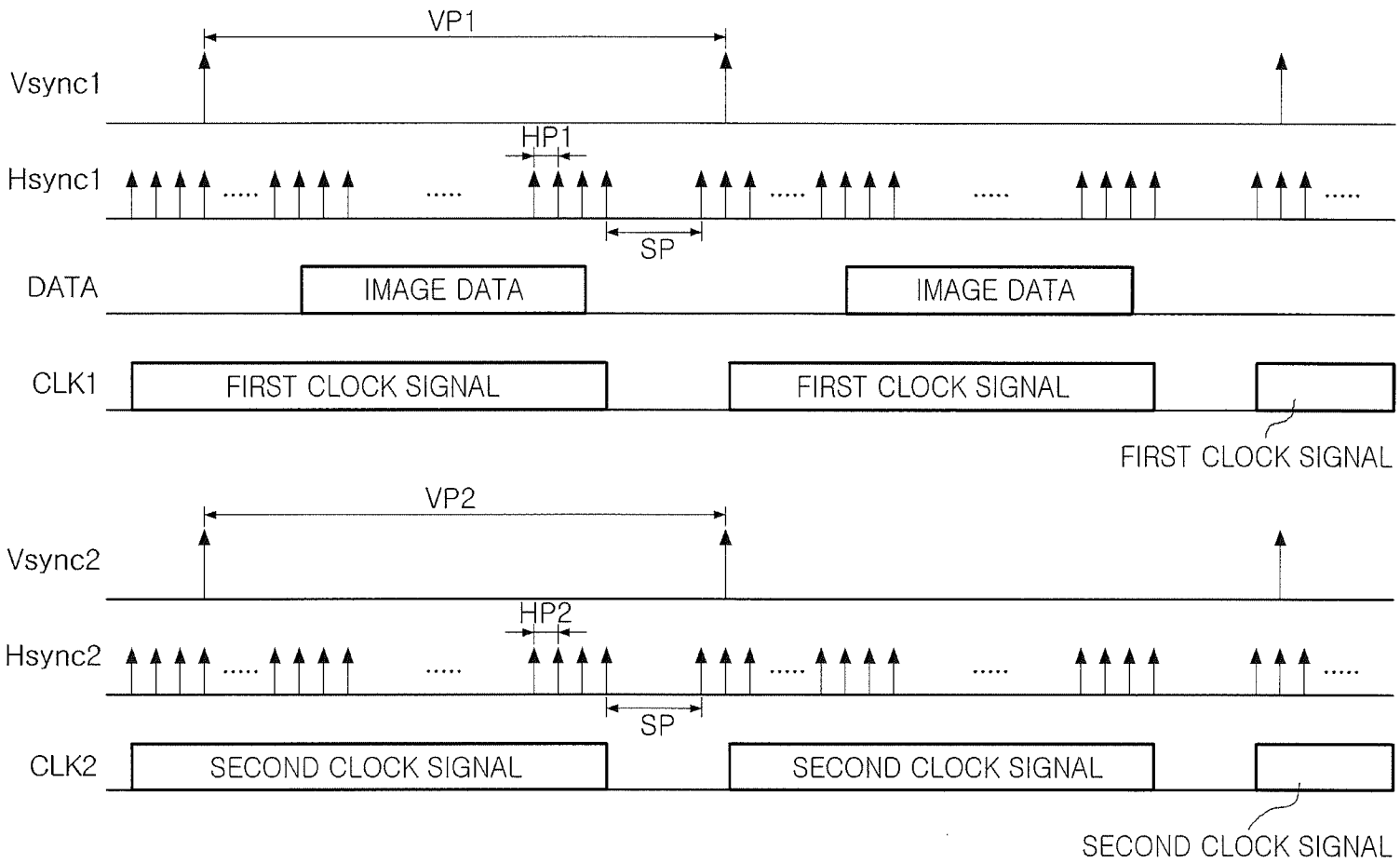
FIGS. 6 to 8 are diagrams illustrating operations of a display driving device according to an example embodiment.
Figure 7:
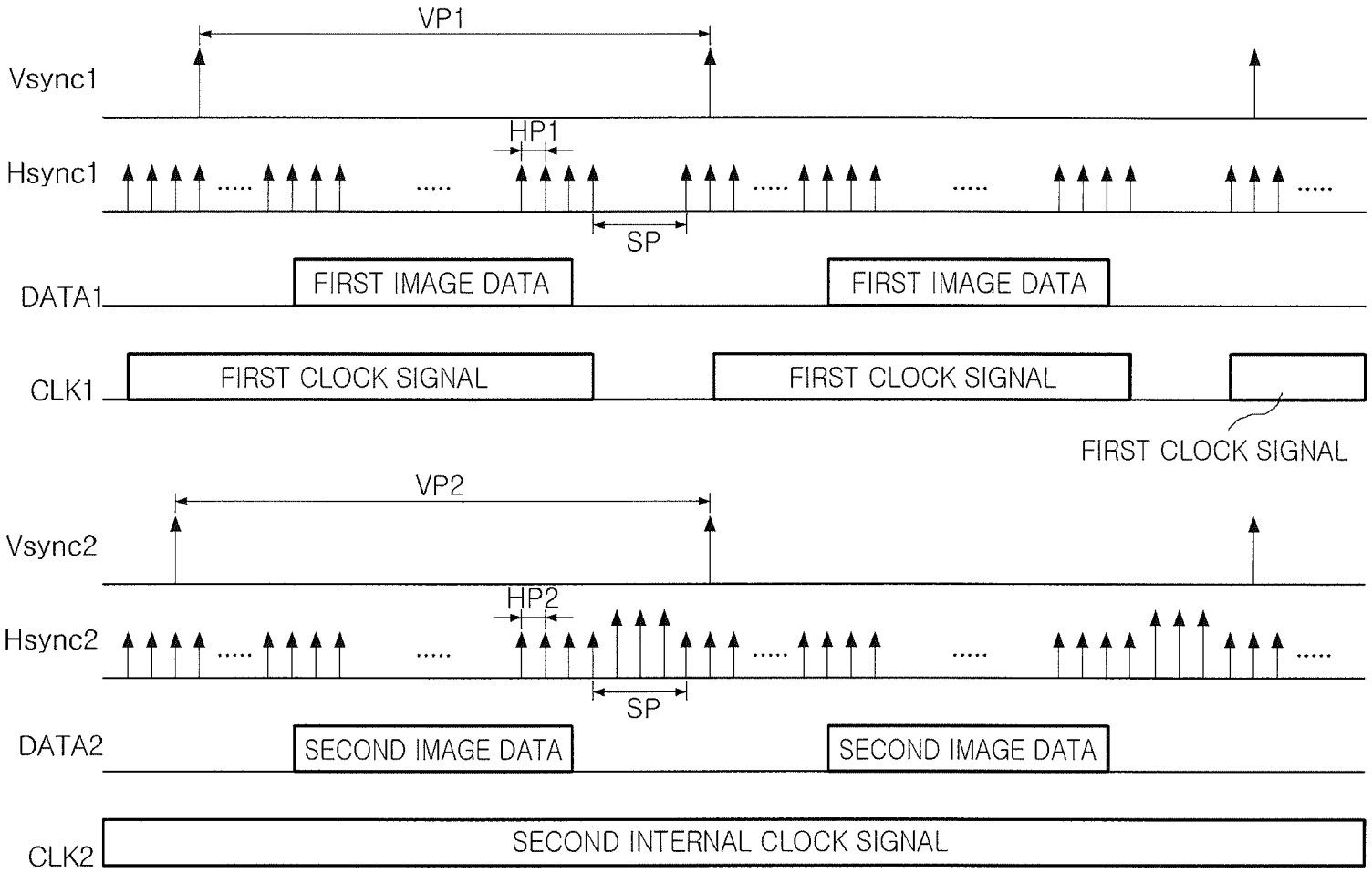
Figure 8:
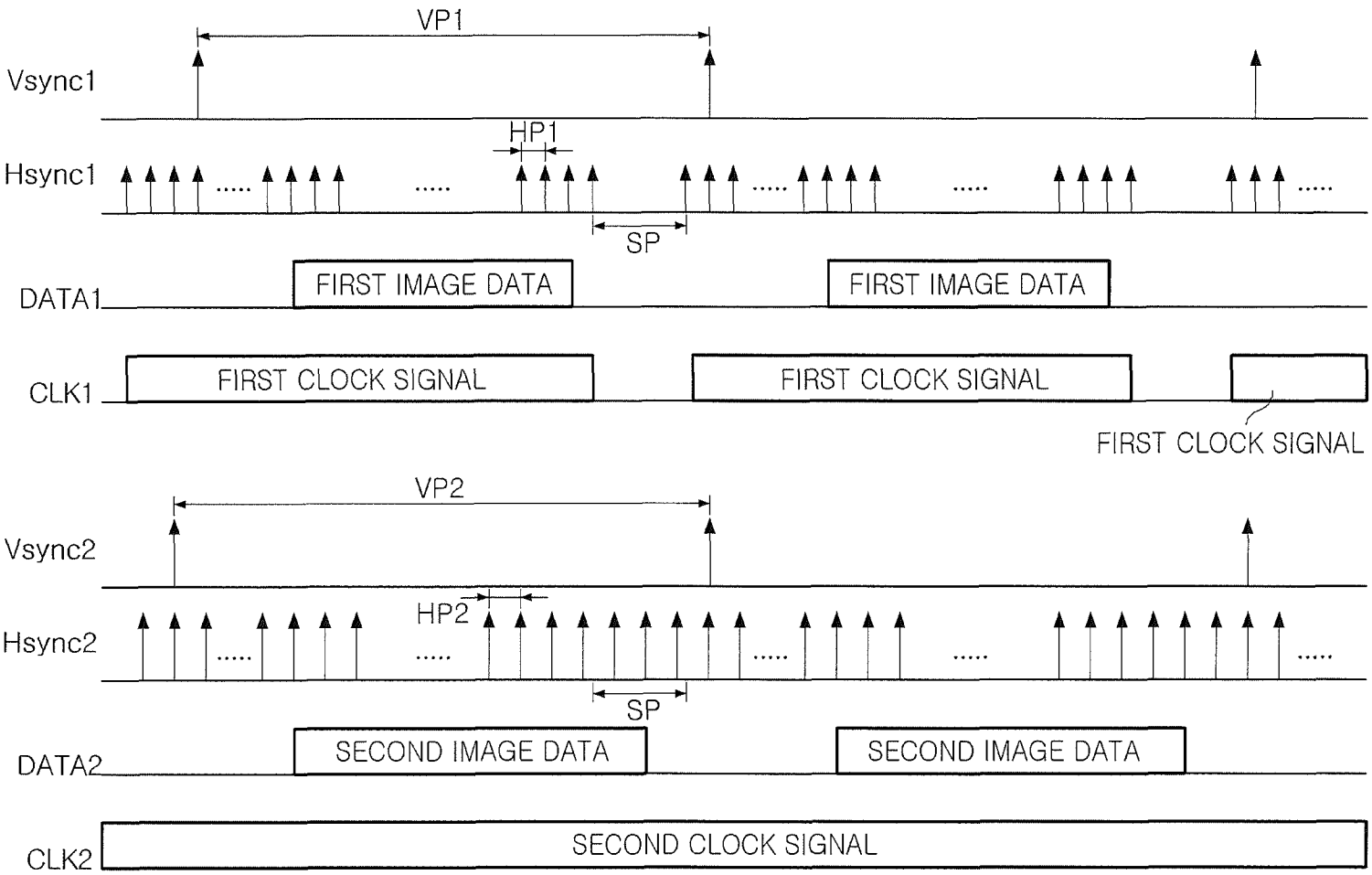

FIGS. 6 to 8 are diagrams illustrating operations of a display driving device according to an example embodiment.

First, FIG. 6 may be a diagram illustrating operations of a common display driving device. Referring to FIG. 6, a processor may generate a first vertical sync signal Vsync1 having a first vertical period VP1, and a first horizontal sync signal Hsync1 having a first horizontal period HP1. The processor may transmit the first vertical sync signal Vsync1 and the first horizontal sync signal Hsync1, along with image data DATA, to the display driving device. The processor may operate in response to a predetermined first clock signal CLK1.

In an example embodiment, the first vertical period VP1 may include a first porch period, an active period, and a second porch period. The image data DATA may be transmitted to the display driving device for the active period. The second porch period, starting after the end of the active period, may include a predetermined clock stop period SP, if necessary. The clock stop period SP may be a time for the processor to change the frequency of the first clock signal CLK1, in order to reduce noise or the like.

For example, the first horizontal period HP1 may be determined in consideration of the first porch period, the second porch period, and the refresh rate and resolution of a display panel. When the refresh rate of the display panel is 60 Hz, the first vertical period VP1 may be about 16.7 msec. When the display panel supports full-high definition (HD) resolution, the number of gate lines included in the display panel may be 1920, and the first horizontal period HP1 may be determined to be about 6.0 μsec. In the example embodiment, the active period may be about 11.52 msec, and the sum of the first porch period and the second porch period included in the first vertical period VP1 may be about 5 msec. When the first porch period or the second porch period is further required, the first horizontal period HP1 may be shorter. For example, the first horizontal period HP1 may be determined according to the following Formula 1.

$$\text{First Horizontal Period} = \frac{\text{First Vertical Period} - \text{First Porch Period} - \text{Second Porch Period}}{\text{Number of Gate Lines}} \quad \text{Formula 1}$$

The display driving device may input the image data DATA to the display panel, using a second vertical sync signal Vsync2 and a second horizontal sync signal Hsync2. The display driving device may operate in response to a second clock signal CLK2. In an example embodiment, the second vertical sync signal Vsync2 and the second horizontal sync signal Hsync2 may be equal to the first vertical sync signal Vsync1 and the first horizontal sync signal Hsync1, respectively. For example, a second vertical period VP2 may be equal to the first vertical period VP1, and a second horizontal period HP2 may be equal to the first horizontal period HP1.

In an example embodiment, the second horizontal period HP2, a time to input the image data DATA to pixels of the display panel, may be longer than the first horizontal period HP1. When the second horizontal period HP2 is set as the same value as the first horizontal period HP1 without considering characteristics and operating conditions of the display panel, the display driving device may not input a sufficient amount of image data DATA to the pixels of the display panel, which may cause a brightness deviation of the display panel.

In an example embodiment, according to the characteristics and operating conditions of the display panel, the second horizontal period HP2 may be set as a value different from the first horizontal period HP1. Thus, when requiring a relatively long second horizontal period HP2, the display driving device may stably input the image data DATA to the pixels of the display panel, thereby addressing an issue of the brightness deviation. Hereinafter, a description will be provided with reference to FIGS. 7 to 8.

First, FIG. 7 is a diagram illustrating operations of a display driving device according to an example embodiment, and may correspond to an example embodiment in which a second horizontal period HP2 is shorter than or equal to a first horizontal period HP1. A processor may generate a first vertical sync signal Vsync1 and a first horizontal sync signal Hsync1. The processor may transmit the first vertical sync signal Vsync1 and first horizontal sync signal Hsync1, along with image data DATA, to the display driving device. The processor may operate in response to a first clock signal CLK1.

The display driving device may include a gate driver and a source driver operating in response to a second vertical sync signal Vsync2 and a second horizontal sync signal Hsync2. The display driving device may input second image data DATA2 to pixels of a display panel. The second image data DATA2 may include substantially the same data as first image data DATA1. In addition, a second vertical period VP2 may be substantially equal to a first vertical period VP1, and a second horizontal period HP2 may be substantially equal to a first horizontal period HP1. Since the first horizontal period HP1 and the second horizontal period HP2 are substantially the same as each other, respective active periods of the first vertical period VP1 and the second vertical period VP2 may be equal to each other.

In the example embodiment illustrated in FIG. 7, the first horizontal sync signal Hsync1 may be inactivated for a clock stop period SP of the first clock signal CLK1. The clock stop period SP may be a time for the processor to change the frequency of the first clock signal CLK1, in order to reduce noise or the like. In contrast, a second clock signal CLK2 generated in the display driving device may not include a clock stop period SP, and thus the second horizontal sync signal Hsync2 may continue to be activated while the first horizontal sync signal Hsync1 is inactivated.

FIG. 8 is a diagram illustrating operations of a display driving device according to an example embodiment, and may correspond to an example embodiment in which a second horizontal period HP2 is longer than a first horizontal period HP1. A processor may generate a first vertical sync signal Vsync1 and a first horizontal sync signal Hsync1. The processor may transmit the first vertical sync signal Vsync1 and first horizontal sync signal Hsync1, along with first image data DATA1, to the display driving device. The processor may operate in response to a first clock signal CLK1.

In the example embodiment illustrated in FIG. 8, according to characteristics and operating conditions of a display panel, the second horizontal period HP2 required by the display driving device may be longer than the first horizontal period HP1 transmitted by the processor. Thus, the display driving device may not use the first vertical sync signal Vsync1 and the first horizontal sync signal Hsync1 transmitted by the processor as they are. The display driving device may generate a second vertical sync signal Vsync2 and a second horizontal sync signal Hsync2 to drive the display panel. The second vertical sync signal Vsync2 and the second horizontal sync signal Hsync2 may be generated using the resolution and refresh rate of the display panel, the first vertical sync signal Vsync1 and the first horizontal sync signal Hsync1 transmitted by the processor, and a second clock signal CLK2 generated in the display driving device.

In an example embodiment, the refresh rate of the display panel may be 60 Hz. Accordingly, a first vertical period VP1 of the first vertical sync signal Vsync1 and a second vertical period VP2 of the second vertical sync signal Vsync2 may both be 1/60 sec, about 16.7 msec. For example, the first vertical period VP1 and the second vertical period VP2 may be equal to each other, and may have values determined according to the refresh rate of the display panel. In an example embodiment, the display driving device may delay the first vertical sync signal Vsync1 by a predetermined delay time, to generate the second vertical sync signal Vsync2.

The first horizontal period HP1 may be determined by a porch period and an active period included in the first vertical sync signal Vsync1, and by the resolution of the display panel. When the display panel has full-HD resolution and the first horizontal period HP1 is 6.0 μsec, the active period may be set at about 11.52 msec or more, and the porch period may be set at about 5.18 msec or less.

In the example embodiment illustrated in FIG. 8, the second horizontal period HP2 required by the display driving device may be longer than the first horizontal period HP1 determined by the processor. The display driving device may generate the second horizontal sync signal Hsync2 having the second horizontal period HP2, by counting the second clock signal CLK2 that is an internal clock signal, for a period of time of the second horizontal period HP2. For example, when the second horizontal period HP2 is 6.6 μsec and the second clock signal CLK2 has a frequency of 100 MHz, the display driving device may determine a time obtained by counting one period of the second clock signal CLK2 660 times, as the second horizontal period HP2, to generate the second horizontal sync signal Hsync2.

However, the method described above may not be suitable to calculate an accurate second horizontal period HP2. It may be difficult for the display driving device to include an oscillator using a phase-locked loop (PLL) method or the like, because of having to prevent power consumption from being increased. Thus, the frequency of the second clock signal CLK2 generated in the display driving device may have a relatively large variation range. For example, when the target frequency of the second clock signal CLK2 is 100 MHz, the frequency of the second clock signal CLK2 may be changed by a maximum of ±5% and, accordingly, the second horizontal period HP2 may also be changed by a maximum of ±5%.

In an example embodiment, to address the above-mentioned issue, the display driving device may generate a first value by counting the first vertical period VP1, using the first horizontal sync signal Hsync1, and may generate a second value by counting the second vertical period VP2, using the second horizontal sync signal Hsync2. When the second vertical period VP2 is equal to the first vertical period VP1, the display driving device may generate the first value and the second value by counting the first vertical period VP1, using each of the first horizontal sync signal Hsync1 and the second horizontal sync signal Hsync2. In addition, the display driving device may generate a third value by counting the first horizontal period HP1, using the second clock signal CLK2.

The first horizontal period HP1 may be obtained from the first horizontal sync signal Hsync1 transmitted by the processor, and the second horizontal period HP2 may be a value previously determined according to characteristics and operating conditions of a display panel. For example, when both the first vertical period VP1 and the second vertical period VP2 are 16.7 msec, the first horizontal period HP1 is 6.0 μsec, and the second horizontal period HP2 is 6.6 μsec, the first value may be 2783 and the second value may be 2530. Assuming that the second clock signal CLK2 is 100 MHz, the third value may be 6000. The display driving device may generate a fourth value to determine the second horizontal period HP2 by inserting the first to third values into the following Formula 2.

$$\text{Fourth Value} = \text{Third Value} \times \frac{\text{First Value}}{\text{Second Value}} \qquad \text{Formula 2}$$

When the value calculated in the example embodiment is inserted into Formula 2, the fourth value may be calculated as 6600. For example, the display driving device may determine a time for which the period of the second clock signal CLK2 is repeated 6600 times, as the second horizontal period HP2. The fourth value calculated according to the frequency variation of the second clock signal CLK2 may be as illustrated in Table 1 below.

TABLE 1

| Frequency | Frequency Variation | First Value | Second Value | Third Value | Fourth Value |
|---|---|---|---|---|---|
| 105 MHz | +5% | 2783 | 2530 | 5714 | 6285 |
| 95 MHz | −5% | 2783 | 2530 | 6315 | 6947 |
| 110 MHz | +10% | 2783 | 2530 | 5455 | 6000 |
| 90 MHz | −10% | 2783 | 2530 | 6667 | 7333 |

For example, in an example embodiment, the frequency variation of the second clock signal CLK2 may have been reflected previously in the third value in an operation process. Thus, the fourth value for generating the second horizontal period HP2 to be 6.6 μsec, a target value, may be accurately generated, regardless of the frequency variation of the second clock signal CLK2. When the frequency of the second clock signal CLK2 is increased, the fourth value, the number of times the display driving device counts the second clock signal CLK2 in order to determine the second horizontal period HP2, may be decreased. In contrast, when the frequency of the second clock signal CLK2 is decreased, the fourth value, the number of times in which the display driving device counts the second clock signal CLK2 in order to determine the second horizontal period HP2, may be increased.

When the display driving device counts the second clock signal CLK2 by a predetermined number of times, to determine the second horizontal period HP2, unlike in an example embodiment, the second horizontal period HP2 may not be determined as a desired value, due to the frequency variation of the second clock signal CLK2. For example, when the second horizontal period HP2 required by the display driving device is 6.6 μsec and the frequency of the second clock signal CLK2 is 100 MHz, the display driving device may determine the second horizontal period HP2 by counting the second clock signal CLK2 6600 times. Here, when the frequency of the second clock signal CLK2 is increased, the second horizontal period HP2 may be decreased. When the frequency of the second clock signal CLK2 is decreased, the second horizontal period HP2 may be increased. For example, the frequency variation of the second clock signal CLK2 may cause the second horizontal period HP2 to be changed, and thus the display driving device may not generate the second horizontal period HP2 to be an accurate target value.

In an example embodiment, the display driving device may obtain the fourth value, the number of times of counting the second clock signal CLK2 required to generate the second horizontal period HP2, using the first value, the second value and the third value. The first value and the second value are obtained by counting the first horizontal period HP1, using each of the first and second horizontal sync signals Hsync1 and Hsync2. The third value is obtained by counting the first horizontal period HP1, using the second clock signal CLK2. Since the frequency variation of the second clock signal CLK2 has been reflected previously in the process of calculating the third value, even when the frequency of the second clock signal CLK2 is changed, the display driving device may generate the second horizontal period HP2 to be an accurate target value.

Figure 9:
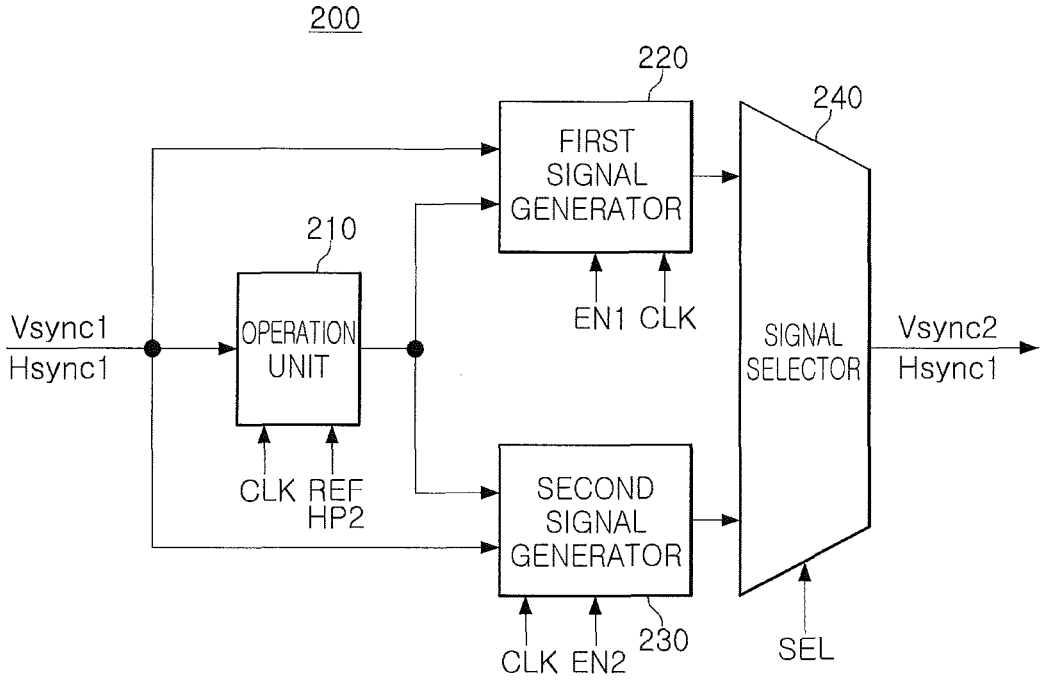
FIGS. 9 to 11 are block diagrams illustrating operations of a sync signal generator included in a display driving device according to an example embodiment.
Figure 10:
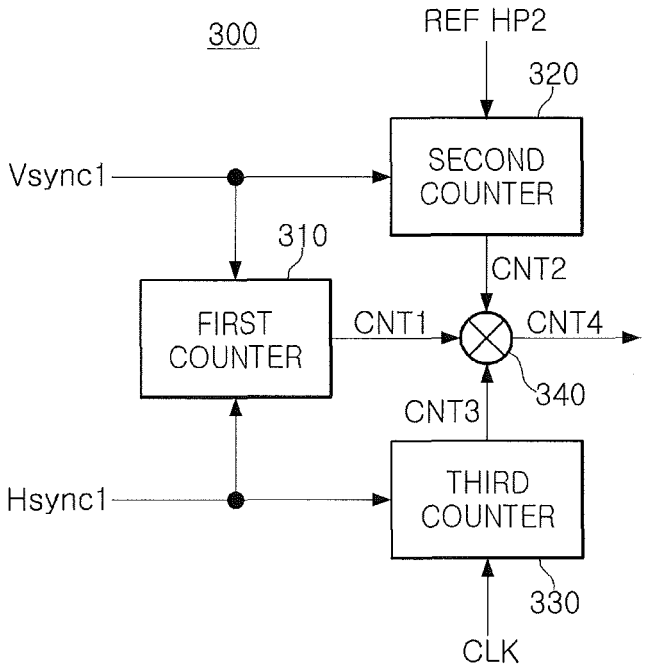
Figure 11:
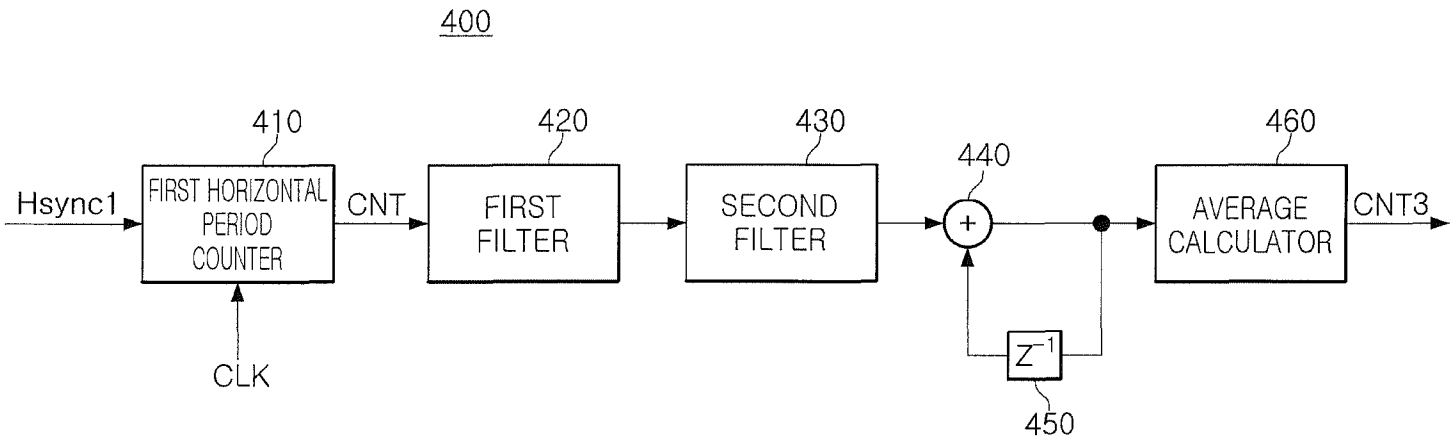

FIGS. 9 to 11 are block diagrams illustrating operations of a sync signal generator, included in a display driving device according to an example embodiment.

Referring first to FIG. 9, the sync signal generator 200 according to the example embodiment may include an operation unit 210, a first signal generator 220, a second signal generator 230, and a signal selector 240. The sync signal generator 200 may receive a first vertical sync signal Vsync1 and a first horizontal sync signal Hsync1 from an external processor, and may generate a second vertical sync signal Vsync2 and a second horizontal sync signal Hsync2.

The operation unit 210 may receive the first vertical sync signal Vsync1 and the first horizontal sync signal Hsync1 from the external processor, and may receive a clock signal CLK having a predetermined frequency. In an example embodiment, the clock signal CLK input to the operation unit 210 may be a signal for counting a first horizontal period HP1. The first horizontal period HP1 is the period of the first horizontal sync signal Hsync1. The clock signal CLK may be a signal generated by an internal oscillator included in the display driving device. In an example embodiment, the period of the second horizontal sync signal Hsync2, to be generated by the sync signal generator 200, i.e., the second horizontal period HP2, may be input to the operation unit 210.

The first signal generator 220 and the second signal generator 230 may operate in response to a first enable signal EN1 and a second enable signal EN2, respectively. For example, the first enable signal EN1 may have a high logic value when the second horizontal period HP2 is longer than the first horizontal period HP1. In addition, the second enable signal EN2 may have a high logic value when the second horizontal period HP2 is shorter than or equal to the first horizontal period HP1.

The operation unit 210 may count a first vertical period VP1, the period of the first vertical sync signal Vsync1, using each of the first horizontal period HP1 and the second horizontal period HP2, to generate a first value and a second value. In addition, the operation unit 210 may count the first horizontal period HP1, using the clock signal CLK to generate a third value. In an example embodiment, the operation unit 210 may calculate a fourth value, using the first to third values, and the fourth value may be the number of times of counting the clock signal CLK in order to determine the second horizontal period HP2.

The operation unit 210 may transmit the fourth value to the first signal generator 220. The first signal generator 220 may count the clock signal CLK by the fourth value to determine the second horizontal period HP2, and may generate the second horizontal sync signal Hsync2 having the second horizontal period HP2. In addition, the first signal generator 220 may delay the first vertical sync signal Vsync1 by a predetermined delay time, if necessary, to generate the second vertical sync signal Vsync2.

In an example embodiment, the first signal generator 220 may generate the second vertical sync signal Vsync2 and the second horizontal sync signal Hsync2 when the first enable signal EN1 has the high logic value. In addition, when the first enable signal EN1 has a low logic value, the first signal generator 220 may bypass the first vertical sync signal Vsync1 and the first horizontal sync signal Hsync1. For example, when the first enable signal EN1 has the low logic value, the second vertical sync signal Vsync2 and the second horizontal sync signal Hsync2 generated by the first signal generator 220 may be equal to the first vertical sync signal Vsync1 and the first horizontal sync signal Hsync1, respectively. For example, the first enable signal EN1 may have the high logic value when a porch period included in the first vertical period VP1 is longer than a predetermined reference time.

When the second enable signal EN2 has the high logic value, the second signal generator 230 may generate the second vertical sync signal Vsync2 and the second horizontal sync signal Hsync2. In an example embodiment, the second vertical sync signal Vsync2 may be equal to the first vertical sync signal Vsync1. The second horizontal period HP2 of the second horizontal sync signal Hsync2 may be shorter than or equal to the first horizontal period HP1 of the first horizontal sync signal Hsync1. In an example embodiment, the second horizontal sync signal Hsync2 may have a period the same length of time as the first horizontal sync signal Hsync1, as in the example embodiment illustrated in FIG. 7, and may continue to be activated even for a clock stop interval SP, unlike in the first horizontal sync signal Hsync1.

The signal selector 240 may select the output of one of the first signal generator 220 and the second signal generator 230, based on a selection signal SEL. In an example embodiment, when the selection signal SEL has a first logic value, the signal selector 240 may select the output of the first signal generator 220, and when the selection signal SEL has a second logic value, the signal selector 240 may select the output of the second signal generator 230. The selection signal SEL may have the first logic value when the porch period included in the first vertical period VP1 is longer than the predetermined reference time, and may have the second logic value when the porch period included in the first vertical period VP1 is shorter than the predetermined reference time.

FIG. 10 is a block diagram of an operation unit included in a signal generator according to an example embodiment.

Referring first to FIG. 10, the operation unit 300 according to the example embodiment may include a first counter 310, a second counter 320, a third counter 330, and a multiplier 340. The first counter 310 may receive a first vertical sync signal Vsync1 and a first horizontal sync signal Hsync1, and may count a first vertical period VP1, using the first horizontal sync signal Hsync1 to generate a first value CNT1.

The second counter 320 may receive the first vertical sync signal Vsync1 and a target second horizontal period REF HP2. The second counter 320 may count the first vertical period VP1, using the target second horizontal period REF HP2, to generate a second value CNT2. The third counter 330 may receive the first horizontal sync signal Hsync1, and a clock signal CLK having a predetermined frequency. The clock signal CLK may be a signal generated by an internal oscillator of a display driving device. The third counter 330 may count the first horizontal period HP1, using the clock signal CLK, to generate a third value CNT3.

In an example embodiment, the display driving device may input image data to pixels of a display panel for a length of time longer than the first horizontal period HP1. Here, the display driving device may generate a second horizontal period HP2, longer than the first horizontal period HP1, to secure a sufficient amount of time to input the image data to the pixels. The second horizontal period HP2 may be determined by counting the clock signal CLK a number of times, determined by a fourth value CNT4, output by the multiplier 340. The multiplier 340 may insert the first to third values CNT1 to CNT3 to Formula 2 to calculate the fourth value CNT4.

In an example embodiment, the first vertical period VP1 and the first horizontal period HP1 may be determined according to the refresh rate and resolution of the display panel, the length of a porch period, or the like. For example, when the refresh rate of the display panel is 120 Hz, the first vertical period VP1 may be about 8.33 msec. When the display panel has full-HD resolution and the porch period is 2.0 msec, the first horizontal period HP1 may be about 3.3 μsec. Assuming that the target second horizontal period REF HP2 is 3.5 μsec, as in the example embodiment, the first value CNT1 may be 2525 and the second value CNT2 may be 2380. Assuming the frequency of the clock signal CLK is 100 MHz, the third value CNT3 may be calculated as 3300.

The multiplier 340 may insert the first to third values CNT1 to CNT3 to Formula 2 to calculate the fourth value CNT4. When the first to third values CNT1 to CNT3 according to the example embodiment are inserted into Formula 2, the fourth value CNT4 may be calculated as 3501. For example, the display driving device may determine a time elapsed while counting the period of the clock signal CLK 3501 times, as the second horizontal period HP2.

According to an example embodiment, the fourth value CNT4, used to generate the second horizontal period HP2, may be calculated using the third value CNT3, generated by counting the first horizontal period HP1 using the clock signal CLK. Thus, the frequency variation of the clock signal CLK may be reflected in the fourth value CNT4, and a deviation between the target second horizontal period REF HP2 and an actually generated second horizontal period HP2 may be significantly reduced.

FIG. 11 is a block diagram of a third counter 400 included in a display driving device. The third counter 400 may count a first horizontal period HP1, using a clock signal CLK to generate a third value CNT3. Referring to FIG. 11, the third counter 400 may include a first horizontal period counter 410, a first filter 420, a second filter 430, an adder 440, a delay unit 450, and an average calculator 460.

The first horizontal period counter 410 may receive a first horizontal sync signal Hsync1 and the clock signal CLK. The first horizontal sync signal Hsync1 may be a signal transmitted by a processor that is connected to the display driving device to communicate therewith, and may have the first horizontal period HP1. The clock signal CLK may be a signal generated by an internal oscillator of the display driving device, and may have a predetermined frequency. The first horizontal period counter 410 may count the first horizontal period HP1, using the clock signal CLK to generate a count value CNT.

Each of the first filter 420 and the second filter 430 may compare the count value CNT to a first reference value and a second reference value. In an example embodiment, the first filter 420 may filter the count value CNT that is greater than the first reference value, an upper limit reference value, and the second filter 420 may filter the count value CNT that is less than the second reference value, a lower limit reference value. The adder 440 and the delay unit 450 may calculate the cumulative sum of the count values CNT that have passed through the first and second filters 420 and 430. The average calculator 460 may calculate the average of the cumulative sum of the count values CNT calculated by the adder 440 and the delay unit 450, and may output the calculated average as the third value CNT3.

When counting only one first horizontal period HP1 using the clock signal CLK, a relatively large error may occur. The third counter 400 according to an example embodiment may count a plurality of first horizontal periods HP1 using the clock signal CLK, and may use the average of the counted first horizontal periods HP1 as the third value CNT3. In addition, the third counter 400 may reduce an error in the calculation by filtering the count value CNT greater than the first reference value or less than the second reference value, among the count values CNT generated by counting the first horizontal periods HP1 using the clock signal CLK.

In an example embodiment, the first horizontal period counter 410 may count 1000 consecutive first horizontal periods HP1, respectively, using the clock signal CLK, to generate 1000 count values CNT. The first filter 420 and the second filter 430 may filter the CNT value greater than the first reference value or less than the second reference value among the 1000 count values CNT. For example, when 10 count values CNT greater than the first reference value are present and 5 count values CNT less than the second reference value are present, the average calculator 460 may calculate the average of the sum of 985 count values CNT that have passed through the first filter 420 and the second filter 430, as the third value CNT3.

Figure 12:
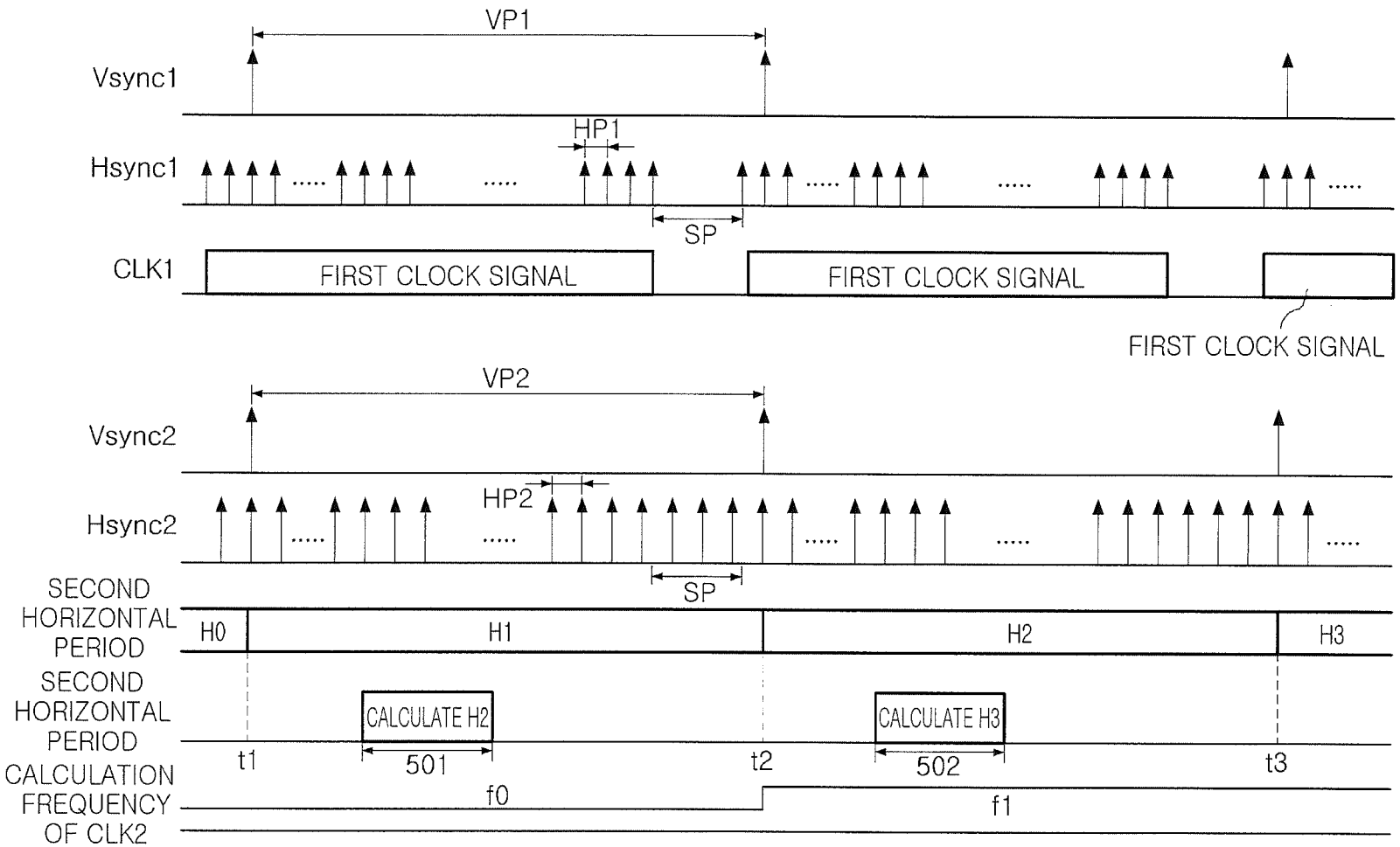
FIGS. 12 to 14 are diagrams illustrating operations of a display driving device according to an example embodiment.
Figure 13:
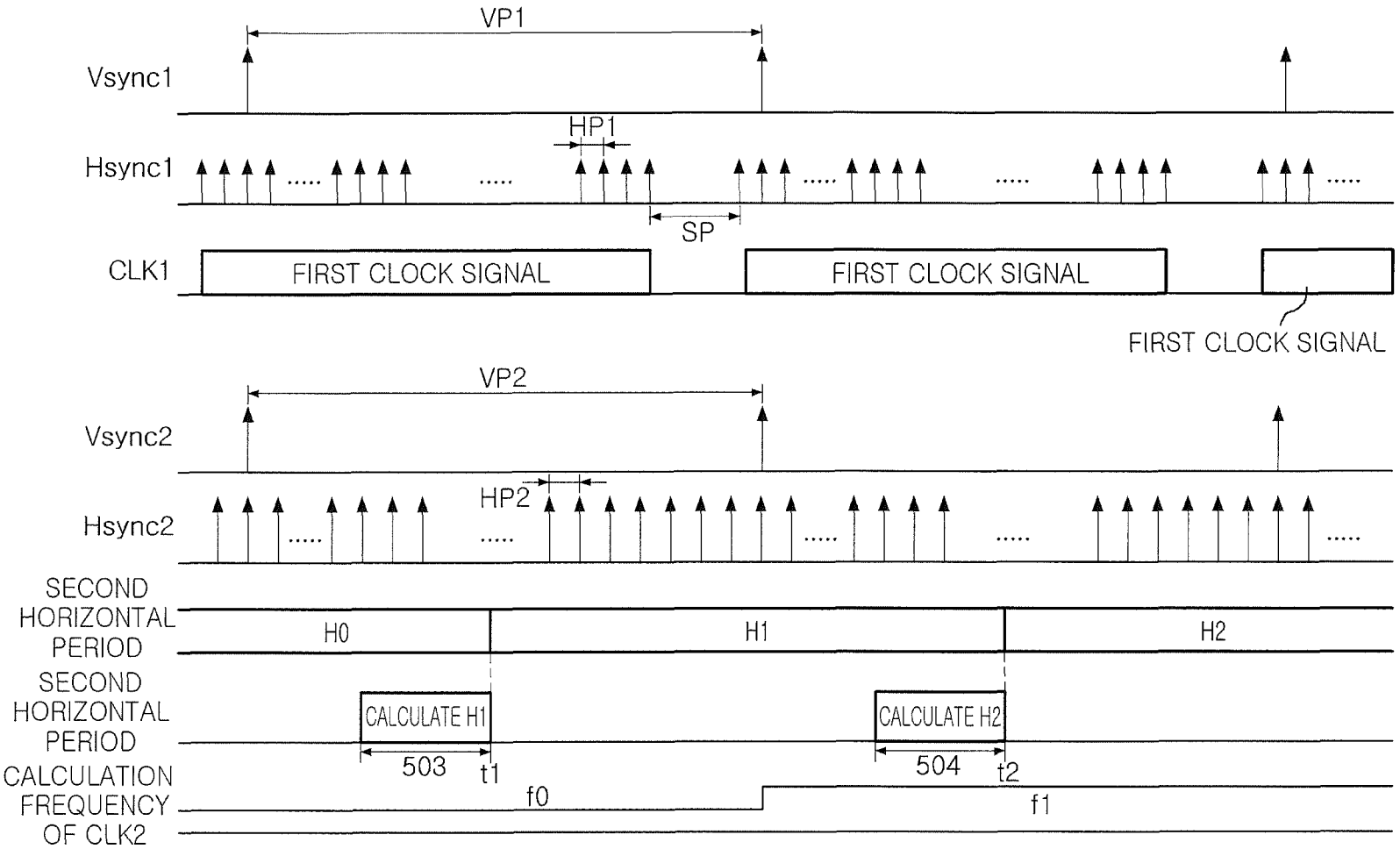
Figure 14:
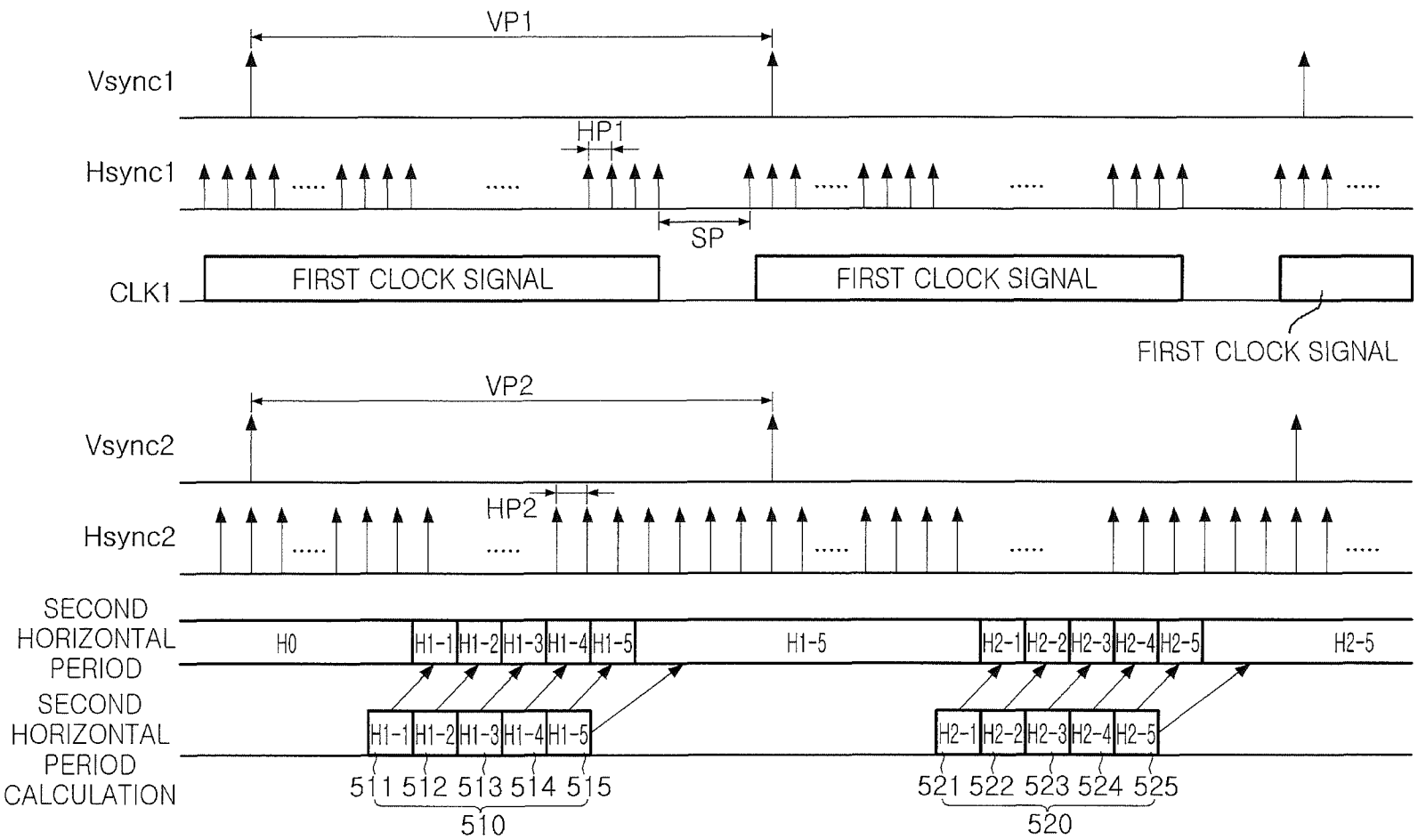

FIGS. 12 to 14 are diagrams illustrating operations of a display driving device according to an example embodiment. In the example embodiments illustrated in FIGS. 12 through 14, the display driving device may drive a display panel using a second horizontal sync signal Hsync2, different from a first horizontal sync signal Hsync1 transmitted by an external processor. A second horizontal period HP2 may be longer than the first horizontal period HP1, and thus a brightness deviation of the display panel may be significantly reduced.

Referring first to FIG. 12, the display driving device may calculate and update the second horizontal period HP2 once per one period of the second vertical sync signal Vsync2. For example, the display driving device may calculate a horizontal period for one second vertical period VP2, and may employ the calculated horizontal period as the second horizontal period HP2 for a subsequent second vertical period VP2. In the example embodiment illustrated in FIG. 12, the frequency of a second clock signal CLK2, generated by an internal oscillator of the display driving device, may not be constant.

Referring to FIG. 12, a horizontal period H2, calculated for a first operation time 501 between t1 and t2, may be employed as a second horizontal period HP2 after t2, at which time a subsequent second vertical period VP2 starts. In addition, a horizontal period H3 calculated for a second operation time 502, between t2 and t3, may be employed as a second horizontal period HP2 after t3, at which time a subsequent second vertical period VP2 starts. Thus, in the example embodiment illustrated in FIG. 12, a time at which the second horizontal period HP2 is updated may coincide with a start time of the second vertical period VP2.

Unlike in the example embodiment illustrated in FIG. 12, the second horizontal period HP2 may be updated as a new value when the calculation of the horizontal period is completed. Referring to FIG. 13, a horizontal period H1, calculated for a first operation time 503, may be employed as a second horizontal period HP2 beginning at t1, at which time the first operation time 503 ends. In addition, a horizontal period H2, calculated for a second operation time 504, may be employed as a second horizontal period HP2 beginning at t2, at which time the second operation time 504 ends. Thus, in the example embodiment illustrated in FIG. 13, a time at which the second horizontal period HP2 is updated may not coincide with a start time of the second vertical period VP2.

The display driving device according to an example embodiment may calculate the second horizontal period HP2 in real time. Referring to FIG. 14, a display driving device may calculate a second horizontal period HP2 for a first operation time 510. The first operation time 510 may include first to fifth intervals 511 to 515. A horizontal period H1-1, calculated for the first interval 511, may be employed simultaneously as a second horizontal period HP2 immediately after the first interval 511 ends. Similarly, each of horizontal periods H1-2 to H1-5, calculated for the second to fifth intervals 512 to 515, respectively, may be employed simultaneously as a second horizontal period HP2 immediately after each of the second to fifth intervals 512 to 515 ends. The horizontal period H1-5, calculated for the fifth interval 515, may continue to be employed as the second horizontal period HP2 until a second operation time 520, a subsequent operation time, starts.

According to an example embodiment illustrated in FIG. 14, the computational complexity of the display driving device may be increased beyond that of the display driving device in the example embodiments illustrated in FIGS. 12 and 13. In contrast, since the second horizontal period HP2 is updated in real time, the frequency variation of a second clock signal CLK2, generated by an internal oscillator of the display driving device, may be reflected rapidly in the second horizontal period HP2. Thus, an error in the second horizontal period HP2, according to the frequency variation of the second clock signal CLK2, may be significantly reduced and, accordingly, a brightness deviation of a display panel may be reduced.

Figure 15:
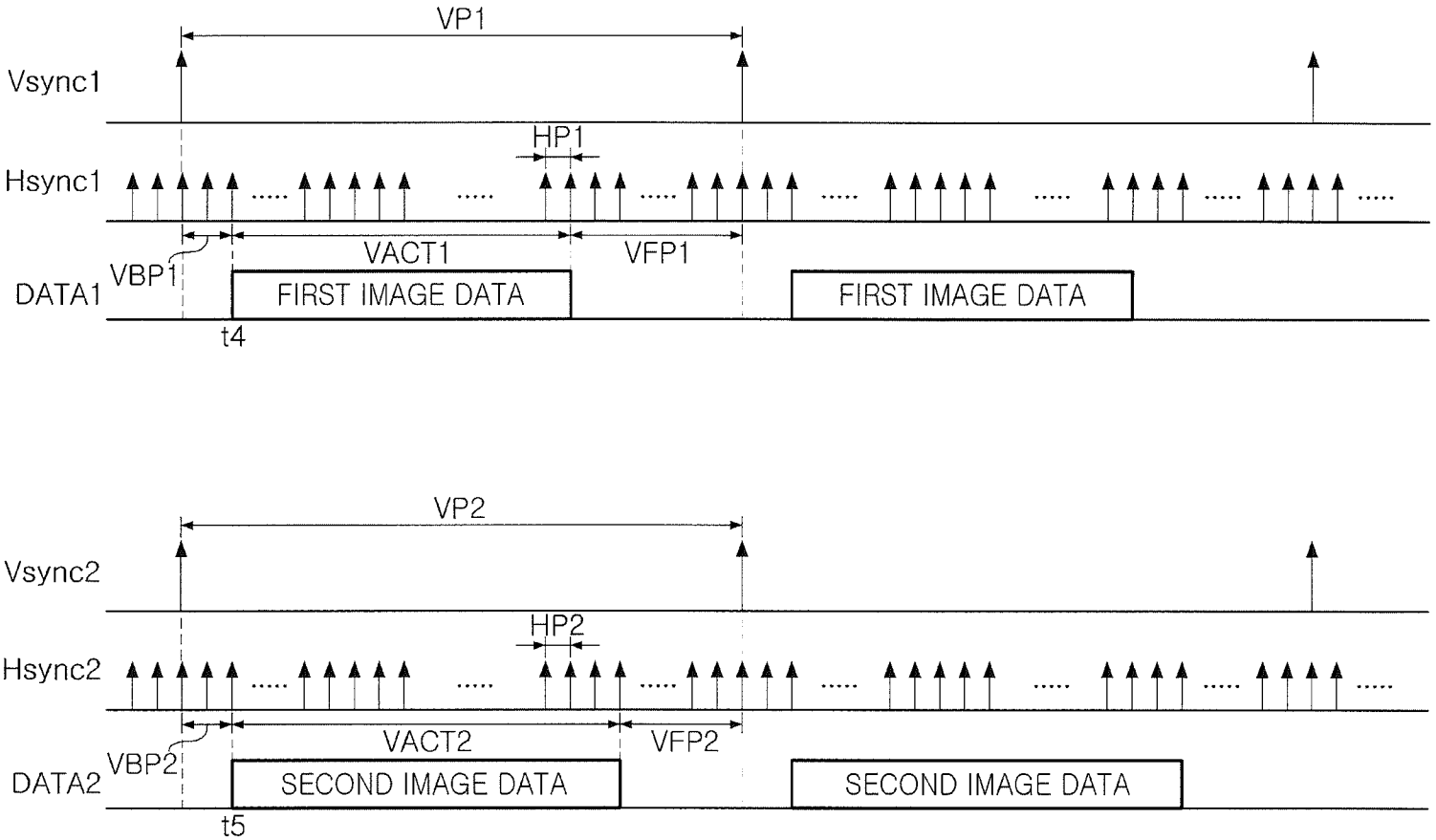
FIGS. 15 and 16 are diagrams illustrating operations of a display driving device according to an example embodiment.
Figure 16:
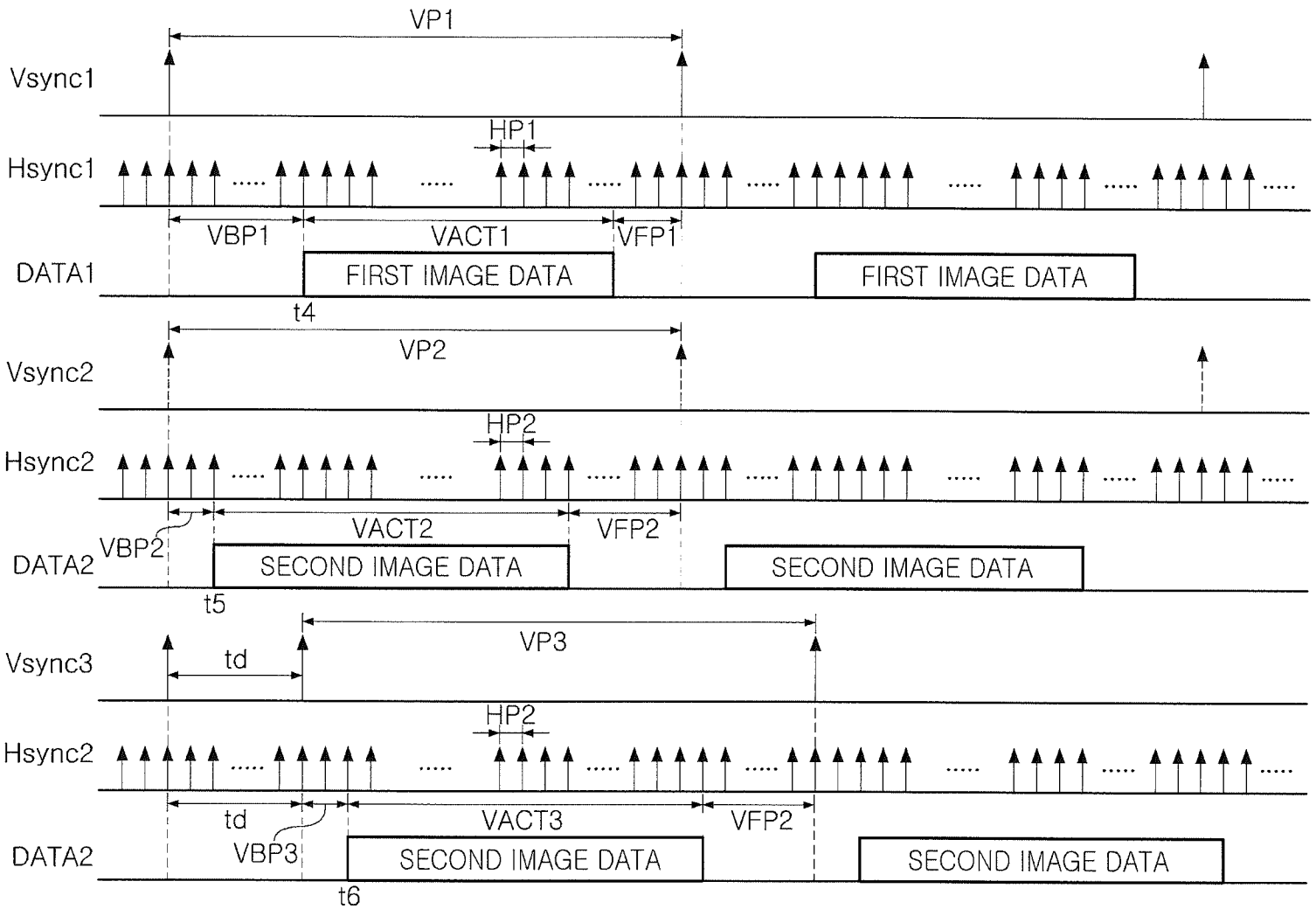

FIGS. 15 and 16 are diagrams illustrating operations of a display driving device according to an example embodiment.

Referring first to FIG. 15, a processor may generate a first vertical sync signal Vsync1 having a first vertical period VP1, and a first horizontal sync signal Hsync1 having a first horizontal period HP1, and may transmit the first vertical sync signal Vsync1 and first horizontal sync signal Hsync1, along with first image data DATA1, to the display driving device. The display driving device may input second image data DATA2 to pixels of a display panel, in response to a second vertical sync signal Vsync2 having a second vertical period VP2, and to a second horizontal sync signal Hsync2 having a second horizontal period HP2. In an example embodiment, the first vertical period VP1 and the second vertical period VP2 may be equal to each other. The first horizontal period HP1 may be shorter than or equal to the second horizontal period HP2.

In the example embodiment illustrated in FIG. 15, the first vertical period VP1 may include a first vertical back porch period VBP1, a first vertical active period VACT1, and a first vertical front porch period VFP1. The second vertical period VP2 may include a second vertical back porch period VBP2, a second vertical active period VACT2, and a second vertical front porch period VFP2. The second vertical back porch period VBP2 may be longer than or equal to the first vertical back porch period VBP1. Thus, t4, a time at which the processor starts to transmit the first image data DATA1, may be equal to t5, a time at which the display driving device starts to input the second image data DATA2 to the pixels, or may arrive prior to t5.

In an example embodiment, when the processor sets the first vertical back porch period VBP1 to be long, a time for the processor to start to transmit the first image data DATA1 may be later than a time for the display driving device to input the second image data DATA2 to the pixels. Here, data for displaying an accurate image may not be input to the pixels. Thus, in an example embodiment, when the first vertical back porch period VBP1 is set to be longer than a certain reference time, the display driving device may delay the first vertical sync signal Vsync1 by a predetermined time, to generate a vertical sync signal. Hereinafter, a description will be provided with reference to FIG. 16.

In the example embodiment illustrated in FIG. 16, the first vertical back porch period VBP1 may be longer than that in the example embodiment illustrated in FIG. 15. Thus, similar to the example embodiment illustrated in FIG. 15, when the first vertical sync signal Vsync1 is used as the second vertical sync signal Vsync2, t4, the time for the processor to start to transmit the first image data DATA1, may be later than t5, the time for the display driving device to start to input the second image data DATA2 to the pixels. As a result, a desired, accurate image may not be displayed on a display device.

Referring to FIG. 16, when the first vertical back porch period VBP1 is longer than a predetermined reference time, the display driving device may delay the first vertical sync signal Vsync1 by a predetermined delay time td, to generate a third vertical sync signal Vsync3, and may input the second image data DATA2 to the pixels in response to the third vertical sync signal Vsync3. Here, the sum of the delay time td and a third vertical back porch period VBP3 included in the third vertical sync signal Vsync3 may be longer than the first vertical back porch period VBP1. In an example embodiment, the delay time td may be equal to the first vertical back porch period VBP1.

In an example embodiment, the display driving device may delay the first vertical sync signal Vsync1 by the delay time td, to generate the third vertical sync signal Vsync3 when the first vertical back porch period VBP1 is longer than a vertical back porch period required by the display driving device. By reflecting the delay time td in the first vertical sync signal Vsync1 to generate the third vertical sync signal Vsync3, t6, a time for the display driving device to start to input the second image data DATA2 to the pixels in response to the third vertical sync signal Vsync3, may arrive later than t4, the time for the processor to start to transmit the first image data DATA1 to the display driving device. Thus, when the processor sets the first vertical back porch period VBP1 to be sufficiently long, an error in image display that may occur on the display device may be prevented.

Figure 17:
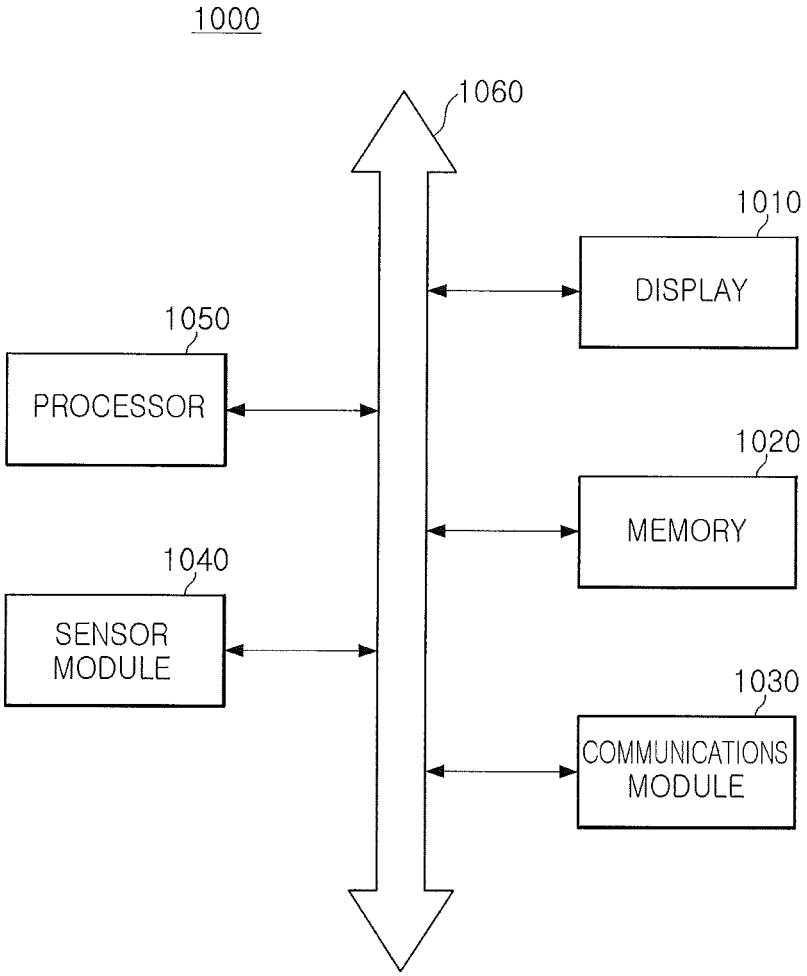
FIG. 17 is a block diagram of an electronic device including a display device according to an example embodiment.

FIG. 17 is a block diagram of an electronic device 1000 including a display device according to an example embodiment.

Referring to FIG. 17, the electronic device 1000 according to the example embodiment may include a display 1010, a memory 1020, a communications module 1030, a sensor module 1040, and a processor 1050. The electronic device 1000 may include a television, a desktop computer, or the like, as well as a mobile device such as a smartphone, a tablet personal computer (PC), a laptop computer, or the like. Components, such as the display 1010, the memory 1020, the communications module 1030, the sensor module 1040, the processor 1050, or the like, may communicate with each other through a bus 1060.

The display 1010 may include a display driving device and a display panel. In an example embodiment, the display driving device may drive the display panel using a vertical sync signal and a horizontal sync signal that the processor 1050 transmits through the bus 1060. The display driving device may generate a new horizontal sync signal having a period longer than that of the horizontal sync signal, and may drive the display panel using the newly generated horizontal sync signal. Thus, the display driving device may secure a sufficient amount of time to input image data to pixels of the display panel, thereby significantly reducing a brightness deviation of the display 1010.

As set forth above, according to example embodiments of the present inventive concept, a display driving device may drive a panel by generating a timing signal having a period different from that of a timing signal received from an external processor, depending on operating conditions. Thus, the display driving device may secure a sufficient amount of time required to input image data to each pixel of the panel. As a result, a brightness deviation of the panel may be significantly reduced.

While exemplary embodiments have been shown and described above, it will be apparent to those skilled in the art that modifications and variations could be made without departing from the scope of the present inventive concept, as defined by the appended claims.

What is claimed is:

1. A display driving device comprising:

a clock generator configured to generate a clock signal having a predetermined frequency;

a sync signal generator configured to:

receive a first vertical sync signal having a first vertical period, and a first horizontal sync signal having a first horizontal period shorter than the first vertical period; and generate a second vertical sync signal, using the first vertical sync signal, and to generate a second horizontal sync signal having a second horizontal period different from the first horizontal period, using the clock signal; and a timing controller configured to drive a display panel based on the second vertical sync signal and the second horizontal sync signal, wherein the sync signal generator counts the first vertical period by the first horizontal period to generate a first value, counts the first vertical period by a target value of the second horizontal period to generate a second value, counts the first horizontal period b the clock signal to generate a third value, and determines the second horizontal period based on the first, second, and third values.

2. The display driving device of claim 1, wherein, when a porch period included in the first vertical period is less than a predetermined reference value, the second horizontal sync signal has the first horizontal period.

3. The display driving device of claim 1, wherein the first vertical period includes a first porch period, an active period, and a second porch period.

4. The display driving device of claim 3, wherein, for at least a portion of the second porch period, the first horizontal sync signal is inactivated, and the second horizontal sync signal is activated.

5. The display driving device of claim 1, wherein the second horizontal period is longer than the first horizontal period.

6. The display driving device of claim 1, wherein the sync signal generator generates the third value by dividing a count value by an integer N, and wherein the count value is obtained by counting a time period having N number of first horizontal periods using the clock signal.

7. The display driving device of claim 1, wherein the sync signal generator generates a plurality of count values by counting the first horizontal period using the clock signal, and generates the third value by averaging values other than values greater than a first reference value or less than a second reference value, among the plurality of count values.

8. The display driving device of claim 1, wherein the sync signal generator generates the second vertical sync signal by delaying the first vertical sync signal by a predetermined delay time, when a back porch period of the first vertical sync signal is longer than a predetermined reference time.

9. The display driving device of claim 1, wherein the first vertical period is determined by a refresh rate of the display panel.

10. The display driving device of claim 1, further comprising a buffer configured to store at least a portion of image data.

11. The display driving device of claim 10, wherein the buffer stores a portion of the image data that is not output to the display panel during an active period of the first vertical period.

12. A display driving device comprising:

a sync signal generator configured to:

receive a first vertical s vile signal having a first vertical period, and a first horizontal sync signal having a first horizontal period shorter than the first vertical period; and generate a second vertical sync signal having the first vertical period, and a second horizontal sync signal having a second horizontal period longer than the first horizontal period;

a timing controller configured to receive image data to a display panel in response to the second horizontal sync signal during an active period of the first vertical period; and a buffer configured to store a portion of the image data that is not output to the display panel during the active period, wherein the sync signal generator counts the first vertical period by the first horizontal period to generate a first value, counts the first vertical period by a target value of the second horizontal period to generate a second value, counts the first horizontal period by a clock signal to generate a third valve, and determines the second horizontal period based on the first, second, and third values.

13. The display driving device of claim 12, wherein the timing controller outputs the portion of the image data stored in the buffer to the display panel during a porch period after the active period.

14. The display driving device of claim 13, wherein the timing controller outputs the portion of the image data stored in the buffer to the display panel in response to the second horizontal sync signal.

15. A display driving device comprising:

a sync signal generator configured to:

receive a first vertical sync signal having a first vertical period that includes a first vertical back porch period, a first vertical active period, and a first vertical front porch period; and generate a second vertical sync signal having a second vertical period that is the same with the first vertical period; and a timing controller configured to receive image data in response to a first horizontal sync signal having a first horizontal period, and to output to a display panel during the second vertical period in response to a second horizontal sync signal having a second horizontal period, wherein the sync signal generator generates the second vertical sync signal by delaying the first vertical sync signal by a predetermined delay time, and wherein the sync signal generator counts the first vertical period by the first horizontal period to generate a first value, counts the first vertical period by a target value of the second horizontal period to generate a second value, counts the first horizontal period by a clock signal to generate a third value, and determines the second horizontal period based on the first, second, and third values.

16. The display driving device of claim 15, wherein the second vertical period includes a second vertical back porch period, a second vertical active period and a second vertical front porch period.

17. The display driving device of claim 16, wherein a sum of the second vertical back porch period and the predetermined delay time is longer than the first vertical back porch period.

18. The display driving device of claim 16, further comprising a buffer configured to store a portion of the image data that is not output to the display panel during the second vertical active period, wherein the timing controller outputs the portion of the image data stored in the buffer to the display panel, during a porch period after the second vertical active period.

19. The display driving device of claim 15, wherein the second horizontal period is longer than the first horizontal period based on a porch period included in the first vertical period being greater than a predetermined reference value.

* * * * *